US006663688B2

(12) United States Patent
Findeisen et al.

(10) Patent No.: US 6,663,688 B2
(45) Date of Patent: Dec. 16, 2003

(54) SINTERED MATERIAL OF SPHEROIDAL SINTERED PARTICLES AND PROCESS FOR PRODUCING THEREOF

(75) Inventors: Eberhard G. Findeisen, Eisenach (DE); Richard F. Moll, Eisenach (DE); Siegmund Kremmer, Wernshausen (DE)

(73) Assignee: WOKA Schweisstechnik GmbH (DE)

( * ) Notice: Subject to any disclaimer, the term of this patent is extended or adjusted under 35 U.S.C. 154(b) by 0 days.

(21) Appl. No.: 10/171,780

(22) Filed: Jun. 17, 2002

(65) Prior Publication Data

US 2003/0000339 A1 Jan. 2, 2003

(30) Foreign Application Priority Data

Jun. 28, 2001 (DE) ..... 101 30 860

(51) Int. Cl.[7] ..... B22F 1/00

(52) U.S. Cl. ..... 75/252; 75/342; 75/351; 75/352

(58) Field of Search ..... 75/342, 351, 352, 75/252

(56) References Cited

U.S. PATENT DOCUMENTS 4,886,638 A * 12/1989 Penkunas et al. ..... 419/15
4,944,774 A 7/1990 Keshaven et al.
5,089,182 A 2/1992 Findeisen et al.
5,102,452 A * 4/1992 Taskinen et al. ..... 75/342
5,589,268 A 12/1996 Kelley et al.
5,663,512 A 9/1997 Schader et al.
5,733,649 A 3/1998 Kelley et al.
5,733,664 A 3/1998 Kelley et al.
5,791,422 A 8/1998 Liang et al.
5,918,102 A 6/1999 Friederichs
5,944,127 A 8/1999 Liang et al.
RE37,127 E 4/2001 Schader et al.

FOREIGN PATENT DOCUMENTS

FR 2667804 10/1990

* cited by examiner

*Primary Examiner*—Ngoclan Mai
(74) *Attorney, Agent, or Firm*—Banner & Witcoff, Ltd.

(57) ABSTRACT

The invention relates to sintered particles for use in wear applications and to a process for producing the sintered particles. The particles are of substantially spheroidal shape, have a grain size of 20 to 180 $\mu$m and have a predominantly closed porosity or are free of pores. The process for producing such particles starts from a powder material with a partially porous internal structure, which is introduced into a furnace and sintered at a temperature at which the material of the metallic binder adopts a pasty state while applying pressure to reduce the pore content of the starting material.

19 Claims, No Drawings

SINTERED MATERIAL OF SPHEROIDAL SINTERED PARTICLES AND PROCESS FOR PRODUCING THEREOF

BACKGROUND OF THE INVENTION

The invention relates to spheroidal sintered particles in the grain size range from 20 to 180 μm and to a process for producing these particles.

In the prior art, sintered particles are used in combination with further hard materials and metallic additives, using various methods, to apply the sintered particles to a substrate which is to be protected against wear and to produce infiltration components with a particular resistance to wear. The sintered particles consist of a hard metal containing sinterable hard material particles, e.g. tungsten carbide grains. The tungsten carbides which are used in the prior art primarily as wear-resistant components are usually embedded in a metallic matrix. Typical examples of the matrix material are the metals cobalt, chromium, nickel, copper and iron or mixtures or alloys thereof.

One particular field of application for sintered hard metal particles is the reinforcing of rock bits used in drilling for oil. The prior art which is relevant to this application area derives, as far as the Applicants are aware, from U.S. Pat. No. 5,791,422, US RE 37,127, US 4,944,774 and US 5,944,127.

U.S. Pat. No. 5,791,422 describes a drill, the teeth of which have a hard facing which contains from 20 to 50% by weight of steel and from 50 to 80% by weight of a filler, the filler including 10 to 100% by weight of particles which consist of fused tungsten carbide and have a particle size of between approximately 16 and 40 mesh (390–1000 μm).

Fused tungsten carbide is typically a eutectic mixture of tungsten and carbon, where manufacturing conditions lead to a phase mixture comprising a WC phase and a $W_2C$ phase is established. It is therefore substoichiometrically carburized, i.e. contains less carbon than the more desirable WC phase.

U.S. Pat. No. RE 37,127 describes a wear-resistant hard material composition which contains at least 60% by weight of granules which contain a fraction of sintered spheroidal cermets and a fraction of pellets of fused tungsten carbide. A range between approximately 16 and approximately 30 mesh (500–1000 μm) is specified for the grain size of the sintered carbide pellets.

U.S. Pat. No. 4,944,774 describes a hard facing composition for teeth of a rock bit, the composition containing a monocrystalline WC and a sintered and fragmented tungsten carbide cermet, the grain sizes being greater than 20 mesh (780 μm).

Moreover, U.S. Pat. No. 5,944,127 discloses a hard facing material for rock bits in which there are crystalline WC particles which have a particle size of less than 200 mesh (75 μm). It is stipulated that it is preferable for the grain size range of the particles to be between 30 and 70 μm.

Apart from U.S. Pat. No. 5,944,127, all the compositions described for sintered powder have the drawback that the grain size of the particles which protect against wear is of an order of magnitude which is unsuitable for certain applications. For example, sand which occurs in the ground has a particle size which may be considerably smaller than the grain size of the carbides used. The inventors have recognized that protection against wear from these particles is more effective if the size of the hard material particles is in the same order of magnitude as the attacking particles.

The hard material composition described in U.S. Pat. No. 5,944,127 contains carbides with a grain size of the same order of magnitude as very fine abrasive particles which are found in the ground. However, the sintered material described has the drawback that, although the tungsten carbides used have a very high hardness, the impact strength and ductility are not optimum, on account of their materials properties.

As a further application area for sintered hard materials, U.S. Pat. No. 5,733,649, US 5,733,664 and US 5,589,268 describe the production of hard material mixtures for the production of infiltrated components, such as diamond drill bits for oil drilling, as part of the prior art. In these patents, the composition of the hard material mixtures, which are referred to as matrix powders, comprises sintered and fragmented cermets of the tungsten carbide/cobalt type, containing from 5 to 20% by weight of metallic binder and having a grain size range of 38 to 125 μm. In addition, monocrystalline tungsten carbide hard materials with a grain size of 45 to 180 μm and fused tungsten carbides with a grain size of less than 53 μm are also used. The grain size distributions, which are adapted to one another, are intended to give the infiltration component which is subsequently produced therefrom a good resistance to erosion in addition to a good resistance to abrasion.

BRIEF SUMMARY OF THE INVENTION

Proceeding from here, the invention is based on the object of providing particles which, applied to a substrate or processed to form a compact body by infiltration, offer improved wear properties with regard to washing out of the matrix and impact strength. Furthermore, it is intended to describe a process for producing a material of this type.

This object is solved by providing sintered hard metal particles of substantially spheroidal shape having a grain size of 20 to 180 μm. These particles have a predominately closed porosity or are substantially free of pores. The decisive advantage of the new, densely sintered pulverulent sintered material is based on the combination of a very high hardness and impact strength with a favourable outer shape with regard to attack from abrasive particles. Especially the small grain size of the particles which is in the same order of magnitude as attacking particles, makes the material eminently suitable for use in reinforcements preventing mineral wear. By way of example, in a process end product consisting of 94% by weight of tungsten carbide and 6% by weight of cobalt, there may be particles which have a hardness of 1380–1690 HV 0.3, the grain size range being 63–106 μm. Furthermore, the closed structure of these particles prevents the penetration of molten metal during processing, so that there are no dissolution phenomena in the core.

Such particles can be produced by a process, comprising the successive steps of:

a) providing a substantially spheroidal powder starting material
b) introducing the powder starting material into a furnace,
c) sintering the powder starting material by heating to a temperature at which the material of the metallic binder adopts a pasty state, and then by applying a gas pressure to reduce the pore content of the starting material, and
d) cooling the spheroidal sintered particles and removing the spheroidal sintered particles from the furnace.

DETAILED DESCRPITION OF THE INVENTION

The starting material provided in step a) has a partially porous internal structure which has a mean grain size which is greater than a predetermined mean grain size of the spheroidal sintered particles substantially by an amount corresponding to the size of the pore content. The material contains 80–97% by weight of sinterable hard material with a grain size of between 0.6 and 5 μm and 3 to 20% by weight of metallic binder. The grain size of the material is 0.6 to 5 μm. It is preferred to use an agglomerated powder material, spray-dried or pelletized as a powder starting material. The grain size is matched to the desired grain size of the end product, which lies in the range between 20 and 180 μm.

Commercially available, suitable spheroidal powder starting materials usually have a partially porous internal structure. Examples of powder starting materials which are commercially available and suitable in principle are the products WOKA 9406-Co and WOKA 8812-Co, agglomerated and sintered, produced by the Assignee of the present invention, WC-Co powders produced by HC Starck (Amperit 518, Amperit 526), Sulzer Metco (Metco 73, Sulzer Metco 5812) and Praxair (WC 616, WC 619). The grain size distribution of the powder starting material is to be selected according to the mean grain size distribution which is predetermined for the spheroidal sintered particles of the process end product to be produced, as will be explained below.

To clarify the terms used, it should be noted that the term closed porosity of the spheroidal sintered particles produced using the process is understood as meaning that the outer surface of the spheroidal sintered particles is non-porous. In many cases, the spheroidal sintered particles produced using the process will be free of pores. The property of the spheroidal sintered particles of having a predominantly closed porosity is based on, in process step c), the material of the metallic binder, on account of its pasty state, forming a closed "layer of material" on the outer side of individual sintered particles.

The powder starting material provided, with a partially open porous structure, is introduced, in step b), into a furnace, for example what is known as a sintering "HIP" furnace (HIP: Hot Isostatic Pressing) for subsequent sintering.

In sintering step c) the material is heated to a temperature such that the binder metal, which usually has a lower melting point than the metal carbide, adopts a pasty state. This leads to an outer surface of the particles being formed as a closed, pasty surface.

Sintering step c) is preferably divided up into subsequent steps c1) and c2). Step c1) includes heating the material to the above described temperature. In step c1), the gas pressure should be as low as possible, preferably a vacuum. After reaching the above described temperature, the individual particles adopt a pasty state. This loads to dosing of the open pores. This is preferably promoted by the applied low pressure or vacuum. Preferably the material is kept at the determined temperature for 10 to 60 minutes; most preferred is a period of about 30 minutes.

Only after the outer surface of the particles is closed, it is possible to reduce the porosity by applying pressure. The gas pressure required in the subsequent part C2) of the sintering step, which may be several MPa, is used to reduce the volume of the individual particles of the powder starting material, specifically by removing the pores or cavities in the interior of the particle of the powder starting material. This is achieved by the externally acting gas pressure compacting the particles of the powder starting material. During part C2) of the sintering step, the temperature is preferably held substantially constant, so that the binder metal remains in its pasty state. The pressure is applied preferably for 10–90 minutes, most preferred for about 40 minutes.

At the same time, the gas pressure causes the particles of the powder starting material, which should already be in a roughly spheroidal shape, to approximately adopt an ideally spheroidal external shape. The volume of the particles of the powder starting material is substantially reduced by the amount which corresponds to the sum of the volumes of the individual pores in the interior of the particles of the powder starting material. Therefore, in the end product it is possible to speak of densely sintered particles. The corresponding porosities, if present, are isolated in the core of the particles, i.e. are not open towards the particle surfaces.

The pulverulent starting material will typically have a pore content of between 5 and 30% by volume. The spheroidal sintered particles of the end product therefore have a density which is approximately 5 to 30% greater than that of the starting material.

The sintered particles, which are the end product of the process, have at least a predominantly closed porosity and may even be free of pores.

Following the sintering step c), the sintered particles are cooled in step d) and then removed from the furnace.

The extent to which sintered bridges are formed in sintering step c) is determined to a considerable extent by the range of the grain size distribution of the powder starting material. The wider the grain size distribution of the powder starting material, the greater the tendency for individual powder particles to agglomerate in sintering step c) via sintered bridges. Powder particles which have sintered together as a result of material bridges are then preferably to be subjected to a milling operation to break open the bridges, but this operation must not destroy the individual particles.

In very extreme cases, if the grain size distribution of the powder starting material is very wide, it is possible that even a milling process will be unable to separate the powder particles from the agglomerates. In this case, to successfully complete the process, the range of the grain size distribution of the powder starting material is to be restricted to such an extent that the formation of the material bridges during sintering step c) is reduced to such an extent that the material bridges can be destroyed by milling. By way of example, the range of the grain size distribution of the powder starting material can be reduced by screening the powder starting material.

It is preferable if, in step a), based on the weight, at least 50% of the starting material particles have a grain size in the range of ±50%, in particular ±15%, of the selected mean grain size of the powder starting material. This ensures that the formation of the material bridges between the powder particles after sintering is reduced to such an extent that at the very least the individual sintered particles can be separated from one another by milling.

However, it should be emphasized that the possibility of obtaining the required range of grain size distribution which is necessary to prevent excessively great formation of material bridges in step c) directly from powder product manufacturers is not excluded.

The individual particles—both of the starting product and the end product—consist of hard metal material, comprising hard material particles embedded in a matrix of a metallic binder.

The hard materials used are preferably selected from the group consisting of the carbides of tungsten (WC), i.e. substantially without $W_2C$ fractions, chromium, niobium, vanadium, titanium, molybdenum and mixtures thereof.

The metallic binder may preferably be selected from the group consisting of cobalt, chromium, nickel, iron and mixtures or alloys thereof.

In principle, all combinations of metallic binders and carbide hard materials are possible; any boundary conditions for special combinations are known to the person skilled in the art.

For reasons of the hardness of the end product of the process, it is preferably to use the stoichiometric carbide of tungsten, which has a carbon content of 6.13% by weight, and to use cobalt as the metallic binder. The powder starting material particularly preferably contains 93–95% by weight of tungsten carbide and 5–7% by weight of cobalt, expediently in the agglomerated, sintered state. Agglomerated and sintered powders are to be preferred over sintered and fragmented powders, since their production process alone means that they already have an approximately spheroidal morphology.

In sintering step c), the temperature may be 10–170° C. below the melting point of the metallic binder; however, the decisive criterion is that the metallic binder be in the pasty state. This is dependent, inter alia, on the binder metal and the amount of this metal, and also on the type of furnace. It will be possible for the person skilled in the art to discover without difficulty at what sintering temperature the pasty intermediate state between solid and liquid phases of the binder metal is established for any binder metal.

The gas pressure is preferably selected as a function of the degree of porosity of the powder starting material, and powder starting materials with a low pore content may require a correspondingly lower gas pressure in sintering step c). The gas pressure in sintering step c) is preferably between 1 and 6 MPa.

An exemplary embodiment of a process for producing the sintered product is explained below:

The commercially available product WOKA 9406 Co, sold by the assignee of the present invention, is used as powder starting material. WOKA 9406 Co is an agglomerated sintered material which consists of 94% by weight of WC and 6% by weight of Co. The individual particles have a porous internal structure. The selected powder starting material which has a grain size range of 5 to 200 $\mu$m, it being possible for in each case 10% by weight to have a grain size which is greater or smaller than the upper or lower grain size limit, is prefractionated by screening. The prefractionation is set to the grain size range from −125+75 $\mu$m.

The agglomerated particles of the selected powder starting material are introduced in graphite boats which are placed in what is known as a sintering HIP furnace.

The material is heated to a temperature of approximately 1430° C. The heating period can last several hours, depending on the type of furnace used. At the temperature of about 1430° C., the Co binder metal adopts a pasty state. After this temperature has been reached, the material is kept at this temperature for about 30 minutes. During this period, a vacuum is applied.

There then follows the second part of the sintering process step, where the temperature is kept approximately constant and an argon gas pressure of 4 MPa is applied. The process time for this pressing period is 40 minutes.

During the sintering step, the volume of the particles of the selected powder starting material is reduced by approximately 20%, so that densely sintered, agglomerated particles are obtained. The particles show a closed porosity. The shape of the particles is spheroidal.

The sintered material is cooled in the sintering HIP furnace. After the process has been carried out, there are small quantities of material bridges between the individual particles of the sintered material. Therefore, the sintered product is milled in order to break open the material bridges. Thus, a powder of individual particles is obtained.

The milling step is followed by a final screening to produce the finished sintered material which has a grain size range of −106+63 $\mu$m. The final screening is only required if a different grain size distribution from that which is established after the milling step is desired.

The finished sintered material has a homogeneous distribution of the tungsten carbide and of the cobalt, a spheroidal external shape on account of the application of the gas pressure and is substantially free of pores.

We claim:

1. A Process for producing spheroidal sintered particles of a predetermined end product mean grain size in the range between 20 and 180 $\mu$m, comprising the steps of:

a) providing a starting material, said starting material being a powder of substantially spheroidal particles, said starting material particles having a partially porous internal structure and a selected starting product mean grain size, where said selected starting product mean grain size is greater than said predetermined end product mean grain size, said starting material particles consisting of 80–97% by weight of sinterable hard material and 3–20% by weight of metallic binder, b) introducing the powder starting material into a furnace, c) sintering the powder starting material by heating to a temperature at which the material of the metallic binder adopts a pasty state and by applying a gas pressure to reduce the pore content of the individual starting material particles, thereby reducing the grain size of the individual starting material particles to the predetermined end product mean grain size, to produce end product particles having a predominantly closed porosity or being free of pores d) cooling and removing the spheroidal end product sintered particles from the furnace.

2. The Process of claim 1, further including a milling step e), following step d), to break open agglomerates of end product sintered particles which have been formed by material bridges, where said material bridges are broken open without destroying the individual end product particles.

3. The Process of claim 1, where sintering step c) is divided into the successive steps of c1) applying a vacuum to the furnace and heating the powder starting material to a temperature at which the material of the metallic binder adopts a pasty state, and c2) applying said gas pressure to reduce the pore content.

4. The Process of claim 1, where the hard material is selected from the group consisting of the carbides of tungsten, chromium, niobium, vanadium, titanium, molybdenum and mixtures thereof.

5. The Process of claim 1, where the grain size of the hard material is between 0.6 and 5 μm.

6. The Process of claim 1, where the metallic binder is selected from the group consisting of cobalt, chromium, nickel, iron and mixtures or alloys thereof.

7. The Process of claim 1, where the grain size of the metallic binder is between 0.6 and 5 μm.

8. The Process of claim 1, where the carbide is tungsten carbide and the metallic binder is cobalt.

9. The Process of claim 8, where the powder starting material contains 93 to 95% by weight of tungsten carbide and 5 to 7% by weight of cobalt.

10. The Process of claim 1, where in step c) the temperature is 10–170° C. below the melting point of the metallic binder.

11. The Process of claim 1, where in step c) the gas pressure is selected as a function of the degree of porosity of the starting material.

12. The Process of claim 1, where in step c) the gas pressure is between 0.1 and 1 MPa.

13. The Process of claim 1, in which in step a), based on the weight, at least 50% of the particles of the starting material have a grain size is in the range of ±50% of the selected starting product grain size.

14. The Process of claim 1, in which in step a), based on the weight, at least 50% of the particles of the starting material have a grain size is in the range of ±15% of the selected starting product grain size.

15. Sintered Particles of substantially spheroidal shape, having a grain size of 20 to 180 μm, and containing 83 to 97% by weight of sinterable hard material, said hard material having a grain size of 0.6 to 5 μm, and further containing 3 to 17% by weight of metallic binder, said metallic binder having a grain size in the range from 0.6 to 5 μm where said particles have a predominantly closed porosity or are free of pores.

16. The sintered particles of claim 15, where the hard material is selected from the group consisting of the carbides of tungsten, chromium, niobium, vanadium, titanium, molybdenum and mixtures thereof.

17. The sintered particles of claim 15, where the metallic binder is selected from the group consisting of cobalt, chromium, nickel, iron and mixtures/alloys thereof.

18. The sintered particles of claim 15, where the sinterable hard material is WC and the metallic binder is cobalt.

19. The sintered particles of claim 15, where the particles contain from 93 to 95% by weight of tungsten carbide and from 5 to 7% by weight of cobalt.

* * * * *